US012163722B2

(12) United States Patent
Lee et al.

(10) Patent No.: US 12,163,722 B2
(45) Date of Patent: Dec. 10, 2024

(54) REFRIGERATOR

(71) Applicant: Samsung Electronics Co., Ltd., Suwon-si (KR)

(72) Inventors: Jooyong Lee, Suwon-si (KR); Ilsung Bae, Suwon-si (KR); Joohee Song, Suwon-si (KR); Jinyoung Song, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 236 days.

(21) Appl. No.: 16/812,104

(22) Filed: Mar. 6, 2020

(65) Prior Publication Data

US 2020/0284493 A1 Sep. 10, 2020

(30) Foreign Application Priority Data

Mar. 7, 2019 (KR) ..... 10-2019-0026466

(51) Int. Cl.
*F25D 17/06* (2006.01)
*F25D 11/02* (2006.01)

(52) U.S. Cl.
CPC ..... *F25D 17/065* (2013.01); *F25D 11/02* (2013.01); *F25D 2317/0671* (2013.01); *F25D 2317/0672* (2013.01); *F25D 2400/06* (2013.01)

(58) Field of Classification Search
CPC ..... F25D 17/065; F25D 11/02; F25D 2317/0671; F25D 2317/0672; F25D 2400/06
See application file for complete search history.

(56) References Cited

U.S. PATENT DOCUMENTS 5,551,252 A * 9/1996 Lee ..... F25D 17/065 62/97
8,856,996 B2 10/2014 Lee et al.
(Continued)

FOREIGN PATENT DOCUMENTS

CN 1273353 A 11/2000
CN 1532494 A 9/2004
(Continued)

OTHER PUBLICATIONS

Translation of JP2017110823, Xu, Jun. 22, 2017, Paragraph 48 (Year: 2017).*
(Continued)

*Primary Examiner* — Elizabeth J Martin
*Assistant Examiner* — Samba Gaye

(57) ABSTRACT

A refrigerator includes a body, a freezing compartment, a plurality of refrigerating compartments adjacent to the freezing compartment in a horizontal direction and including a first refrigerating compartment and a second refrigerating compartment, a freezing compartment cooling space arranged behind the freezing compartment to communicate with the freezing compartment, a freezing compartment partition configured to partition the freezing compartment and the freezing compartment cooling space and including a freezing compartment duct, an evaporator configured to generate cooling air, a first duct configured to supply the cooling air to the first refrigerating compartment and including a first cooling air inlet, and a second duct configured to supply the cooling air to the second refrigerating compartment through a second cooling air inlet formed on one wall of the freezing compartment duct. The first cooling air inlet and the second cooling air inlet are arranged above the evaporator.

8 Claims, 13 Drawing Sheets

(56) References Cited

U.S. PATENT DOCUMENTS

| | | | | |
|---|---|---|---|---|
| 2004/0188935 | A1* | 9/2004 | Nam | F25D 17/045 273/276 |
| 2004/0261444 | A1 | 12/2004 | Chastine | |
| 2005/0126207 | A1 | 6/2005 | Lee et al. | |
| 2015/0052932 | A1* | 2/2015 | Allard | F25D 17/065 454/195 |
| 2015/0308730 | A1* | 10/2015 | Gu | F25D 23/069 62/408 |

FOREIGN PATENT DOCUMENTS

| | | | | | |
|---|---|---|---|---|---|
| CN | 102494460 | A | | 6/2012 | |
| CN | 103499171 | A | * | 1/2014 | |
| CN | 108088147 | A | | 5/2018 | |
| CN | 108548355 | A | | 9/2018 | |
| JP | 2015-055363 | A | | 3/2015 | |
| JP | 2017-110823 | A | | 6/2017 | |
| KR | 2000060143 | A | * | 10/2000 | |
| KR | 10-2004-0049611 | A | | 6/2004 | |
| KR | 20060111274 | A | * | 10/2006 | F25D 11/00 |
| KR | 10-0678777 | B1 | | 2/2007 | |
| KR | 2007071094 | A | * | 7/2007 | |
| KR | 10-2009-0046241 | A | | 5/2009 | |
| KR | 10-2009-0055133 | A | | 6/2009 | |
| KR | 10-1118722 | B1 | | 3/2012 | |
| KR | 10-2013-0136205 | A | | 12/2013 | |
| KR | 10-2014-0019596 | A | | 2/2014 | |
| KR | 10-2017-0027628 | A | | 3/2017 | |
| KR | 10-2018-0069678 | A | | 6/2018 | |
| WO | 2009069900 | A2 | | 6/2009 | |
| WO | WO-2018040441 | A1 | * | 3/2018 | F25D 17/06 |

OTHER PUBLICATIONS

Translation of KR20060111274, Chung, Oct. 27, 2006, Paragraph 39 (Year: 2006).*
Translated_Tao (Year: 2018).*
Translated_Yao (Year: 2014).*
Translated_Kim (Year: 2000).*
Translated_Yoon (Year: 2007).*
International Search Report and Written Opinion of the International Searching Authority in connection with International Application No. PCT/KR2020/002736 dated Jun. 25, 2020, 3 pages.
European Search Report in connection with European Application No. 20161598.6 dated Jul. 16, 2020, 9 pages.
European Patent Office, "Communication under Rule 71(3) EPC" issued Oct. 18, 2021, in connection with European Patent Application No. 20161598.6, 50 pages.
The First Office Action dated Jun. 9, 2022, in connection with Chinese Application No. 202080018997.7, 16 pages.
European Search Report dated May 24, 2022, in connection with European Application No. 22156659.9, 7 pages.
Communication pursuant to Article 94(3) EPC dated Aug. 29, 2023, in connection with European Application No. 22156659.9, 6 pages.
Notice of Requesting Submission of Opinion dated Aug. 22, 2023, in connection with Korean Application No. 10-2019-0026466, 24 pages.
Notice of Patent Allowance dated Oct. 30, 2023, in connection with Korean Application No. 10-2019-0026466, 3 pages.

* cited by examiner

REFRIGERATOR

CROSS-REFERENCE TO RELATED APPLICATION

This application is based on and claims priority under 35 U.S.C. § 119 to Korean Patent Application No. 10-2019-0026466, filed on Mar. 7, 2019, in the Korean Intellectual Property Office, the disclosure of which is herein incorporated by reference in its entirety.

BACKGROUND

1. Field

The disclosure relates to a refrigerator, and more particularly, to a refrigerator having an improved structure to control temperatures of a plurality of storage compartments by one evaporator.

2. Description of Related Art

A refrigerator is an appliance to keep food fresh by including a body having a storage compartment, and a cooling air supply system to supply cooling air to the storage compartment. The storage compartment includes a refrigerating compartment kept at a temperature of approximately 0° C.~5° C., to store food in a refrigerated state, and a freezing compartment kept at a temperature of approximately −30° C.~0° C., to store food in a frozen state.

The refrigerator may be classified by a position of the refrigerating compartment and the freezing compartment. Particularly, the refrigerator may be classified into a Bottom Mounted Freezer (BMF) type refrigerator in which a refrigerating compartment is formed in the upper portion and a freezing compartment is formed in the lower portion, a Top Mounted Freezer (TMF) type refrigerator in which a freezing compartment is formed in the upper portion and a refrigerating compartment is formed in the lower portion, and a Side by Side (SBS) type refrigerator in which a freezing compartment and a refrigerating compartment are formed side by side in the left and right direction. Further, the refrigerator may be classified by the number of the door, and thus the refrigerator may be classified into two-door type refrigerator, three-door type refrigerator, and four-door type refrigerator.

In general, the refrigerator may include a freezing compartment evaporator provided to supply cooling air to the freezing compartment, and a refrigerating compartment evaporator provided to supply cooling air to the refrigerating compartment. Recently, a refrigerator that can supply cooling air to each of the freezing compartment and the refrigerating compartment by one evaporator has been developed and popular in users.

If the refrigerator has one freezing compartment and one refrigerating compartment, there is no difficulty to cool the freezing compartment and the refrigerating compartment by one evaporator. However, when the refrigerator includes one freezing compartment and a plurality of refrigerating compartments, it may be difficult to independently control the temperatures of the plurality of refrigerating compartments through one evaporator.

SUMMARY

Therefore, it is an aspect of the disclosure to provide a refrigerator having an improved structure to independently control the temperatures of a plurality of refrigerating compartments by one evaporator.

Additional aspects of the disclosure will be set forth in part in the description which follows and, in part, will be obvious from the description, or may be learned by practice of the disclosure.

In accordance with an aspect of the disclosure, a refrigerator includes a body, a freezing compartment provided in the inside of the body, a plurality of refrigerating compartments provided in the inside of the body to be adjacent to the freezing compartment in a horizontal direction, and including a first refrigerating compartment and a second refrigerating compartment, a freezing compartment cooling space arranged behind the freezing compartment to communicate with the freezing compartment, a freezing compartment partition configured to divide the freezing compartment and the freezing compartment cooling space and including a freezing compartment duct, an evaporator arranged in the freezing compartment cooling space to generate cooling air, a first duct configured to allow the cooling air generated by the evaporator to be supplied to the first refrigerating compartment and including a first cooling air inlet, and a second duct configured to allow the cooling air generated by the evaporator to be supplied to the second refrigerating compartment through a second cooling air inlet formed on one wall of the freezing compartment duct. The first cooling air inlet and the second cooling air inlet are arranged above the evaporator.

The first refrigerating compartment and the second refrigerating compartment may be divided in a vertical direction by a divider while communicating with each other.

The refrigerator may further include a plurality of refrigerating compartment cooling spaces arranged behind the plurality of refrigerating compartments while communicating with the plurality of refrigerating compartments. The plurality of refrigerating compartment cooling spaces may include a first refrigerating compartment cooling space provided to communicate with the first refrigerating compartment and a second refrigerating compartment cooling space provided to communicate with the second refrigerating compartment.

The first duct may connect the freezing compartment duct to the first refrigerating compartment cooling space, and the second duct may connect the freezing compartment duct to the second refrigerating compartment cooling space.

The refrigerator may further include a first damper configured to selectively open or close the first duct, and a second damper configured to selectively open or close the second duct independently of the first damper.

The first damper may be configured to selectively open or close the first cooling air inlet.

Cooling air introduced through the first cooling air inlet may be discharged into the first refrigerating compartment cooling space through a first cooling air outlet, and cooling air introduced through the second cooling air inlet may be discharged into the second refrigerating compartment cooling space through a second cooling air outlet. The refrigerator further may include a first damper configured to selectively open or close the first cooling air outlet, and a second damper configured to selectively open or close the second cooling air outlet.

The second cooling air inlet may be arranged above the second cooling air outlet.

The refrigerator may further include a third duct configured to allow air, which is introduced through the first cooling air inlet and circulated through the first refrigerating compartment, and air, which is introduced through the second cooling air inlet and circulated through the second refrigerating compartment, to be supplied to the freezing compartment cooling space.

The third duct may connect the second refrigerating compartment to the freezing compartment cooling space.

The third duct may connect a third cooling air inlet formed on one wall of the second refrigerating compartment to a third cooling air outlet formed on one wall of the freezing compartment cooling space to allow cooling air, which is introduced through the third cooling air inlet, to be discharged to the lower side of the evaporator.

The third cooling air inlet may be arranged above the third cooling air outlet.

In accordance with an aspect of the disclosure, a refrigerator includes a body, a freezing compartment provided in the inside of the body, a freezing compartment cooling space arranged behind the freezing compartment, a freezing compartment partition configured to divide the freezing compartment and the freezing compartment cooling space and including a freezing compartment duct, an evaporator arranged in the freezing compartment cooling space to generate cooling air, a plurality of refrigerating compartments provided in the inside of the body to be adjacent to the freezing compartment in a horizontal direction, and including a first refrigerating compartment and a second refrigerating compartment, a plurality of refrigerating compartment cooling spaces arranged behind the plurality of refrigerating compartments and including a first refrigerating compartment cooling space arranged behind the first refrigerating compartment and a second refrigerating compartment cooling space arranged behind the second refrigerating compartment; and a cooling air supply duct configured to allow cooling air generated by the evaporator to be supplied to the plurality of refrigerating compartments and including a cooling air inlet arranged above the evaporator.

The refrigerator may further include a divider configured to divide the first refrigerating compartment and the second refrigerating compartment in a vertical direction to communicate with each other such that the first refrigerating compartment is placed above the second refrigerating compartment.

Cooling air introduced through the cooling air inlet may be discharged into the first refrigerating compartment cooling space through a first cooling air outlet formed on one wall of the first refrigerating compartment cooling space, and cooling air introduced through the cooling air inlet may be discharged into the second refrigerating compartment cooling space through a second cooling air outlet formed on one wall of the second refrigerating compartment cooling space.

The cooling air supply duct may connect the cooling air inlet, the first cooling air outlet, and the second cooling air outlet. The cooling air introduced through the cooling air inlet may be branched inside the cooling air supply duct and thus a part of the cooling air may be discharged into the first refrigerating compartment cooling space through the first cooling air outlet, and the other part of the cooling air may be discharged into the second refrigerating compartment cooling space through the second cooling air outlet.

The cooling air inlet may include a first cooling air inlet and a second cooling air inlet arranged below the first cooling air inlet. The cooling air supply duct may include a first duct configured to allow cooling air, which is introduced through the first cooling air inlet, to be discharged to the first refrigerating compartment cooling space through the first cooling air outlet, and a second duct configured to allow cooling air, which is introduced through the second cooling air inlet, to be discharged to the second refrigerating compartment cooling space through the second cooling air outlet.

The freezing compartment partition may include at least one outlet configured to allow cooling air generated by the evaporator to be supplied to the freezing compartment. The refrigerator may further include a refrigerating compartment partition arranged to divide the plurality of refrigerating compartments and the plurality of refrigerating compartment cooling spaces, and including at least one outlet configured to allow cooling air passing through the cooling air supply duct to be supplied to the plurality of refrigerating compartments.

The refrigerator may further include a plurality of dampers arranged in the cooling air supply duct to independently control whether to provide cooling air to each of the plurality of refrigerating compartment cooling spaces.

The refrigerator may further include a cooling air circulation duct configured to allow air, which is introduced through the cooling air inlet and circulated through the first refrigerating compartment and the second refrigerating compartment, to be supplied to the freezing compartment cooling space. The cooling air circulation duct may connect the second refrigerating compartment to the freezing compartment cooling space.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter embodiments of the disclosure will be described with reference to drawings. In the following detailed description, the terms of "front end", "rear end", "upper portion", "lower portion", "upper end", "lower end" and the like may be defined by the drawings, but the shape and the location of the component is not limited by the term.

Figure 1:
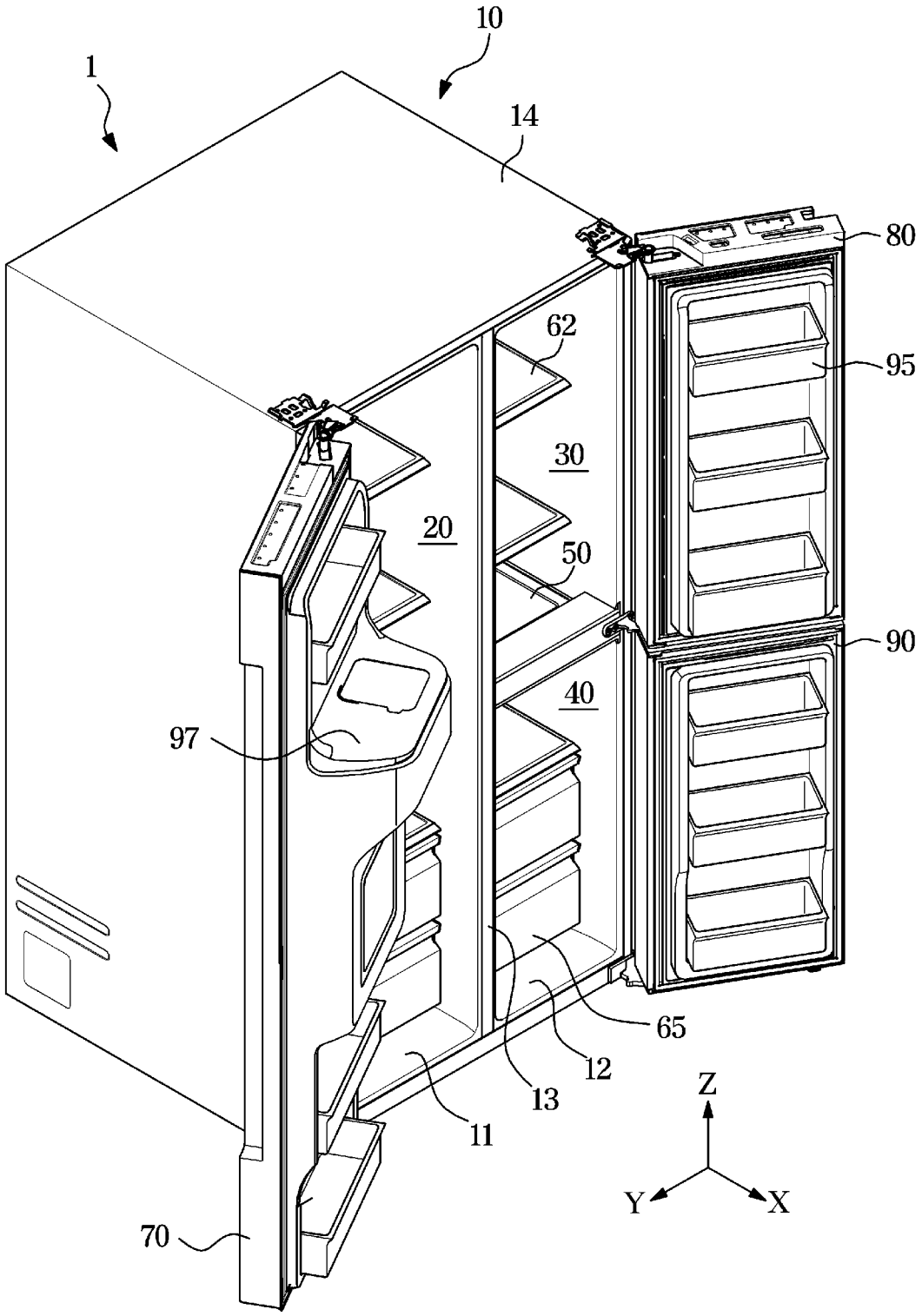
FIG. 1 illustrates a perspective view of a refrigerator according to an embodiment of the disclosure.
Figure 2:
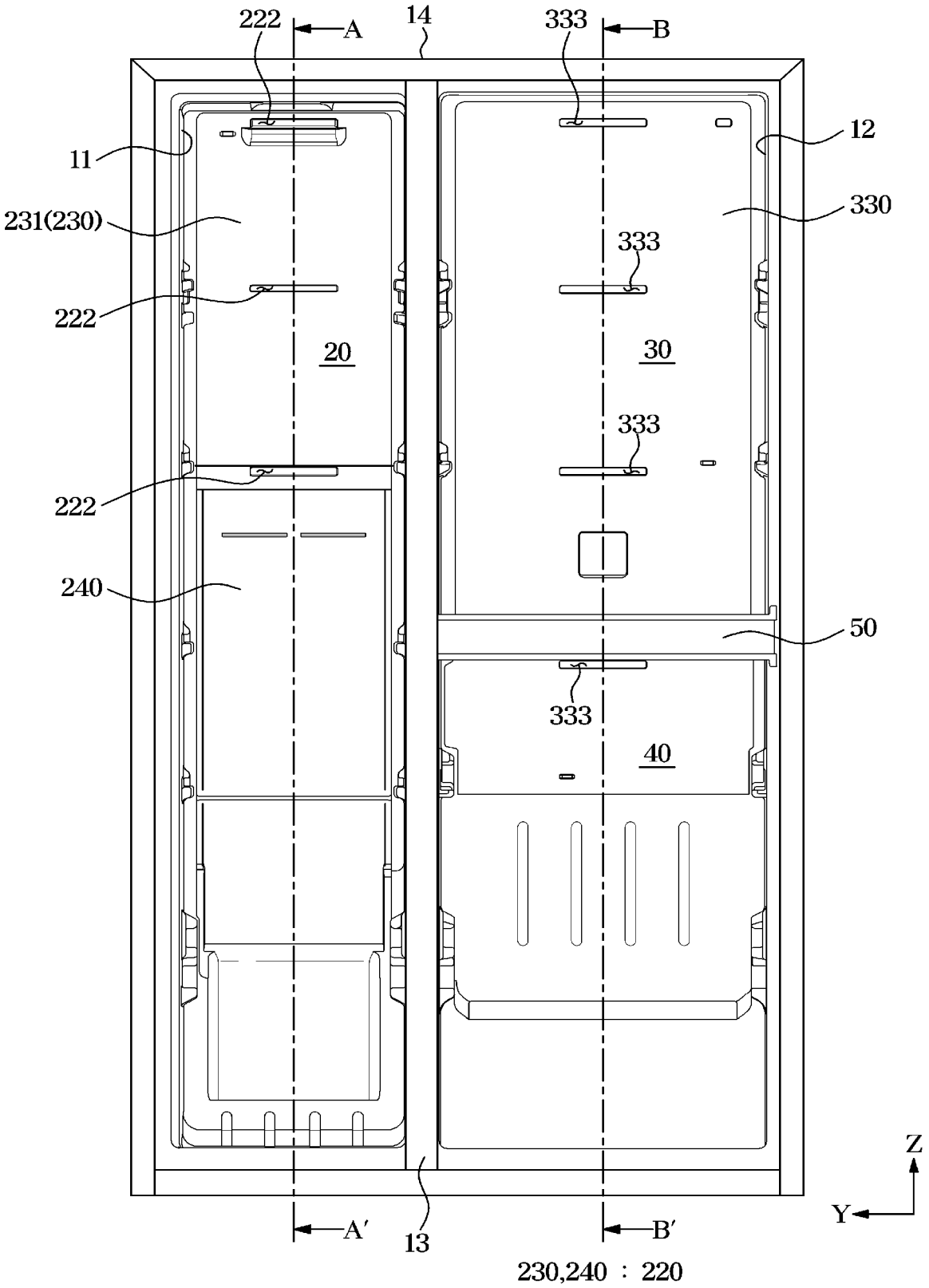
FIG. 2 illustrates a front view of a portion of the refrigerator according to an embodiment of the disclosure.
Figure 3:
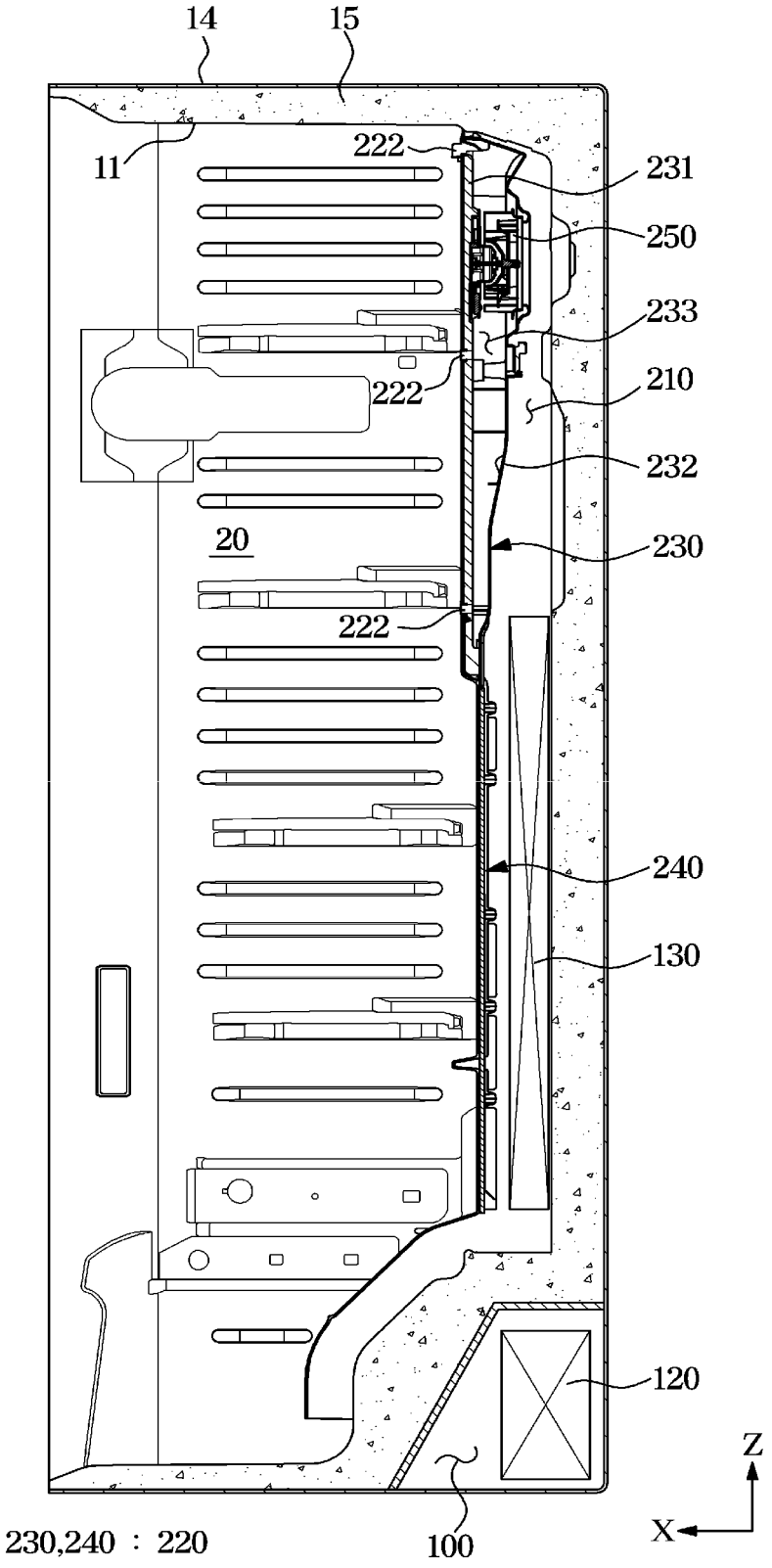
FIG. 3 illustrates a sectional view taken along line A-A' of the refrigerator of FIG. 2.
Figure 4:
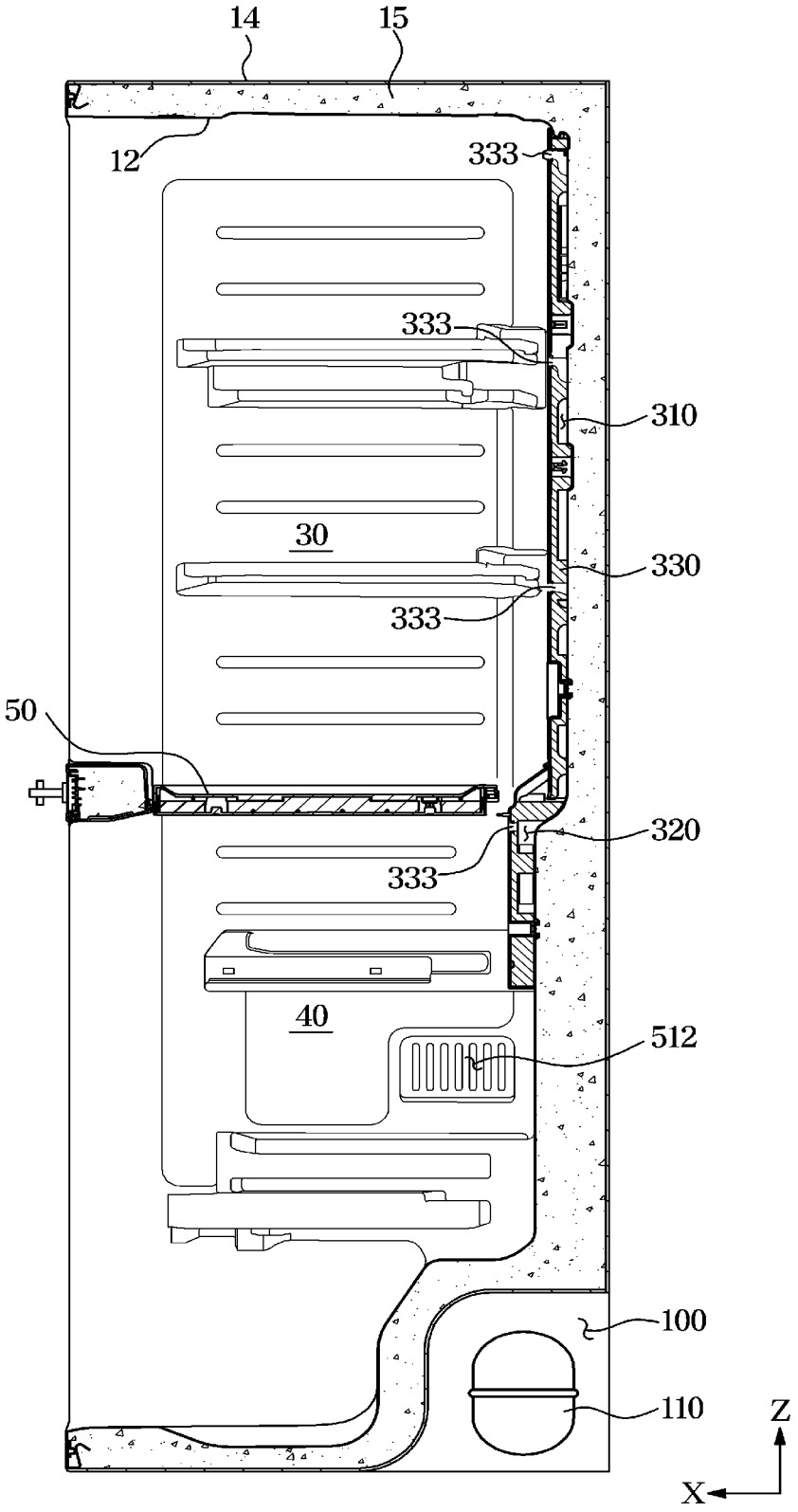
FIG. 4 illustrates a sectional view taken along line B-B' of the refrigerator of FIG. 2.

FIG. 1 illustrates a perspective view of a refrigerator according to an embodiment of the disclosure, FIG. 2 illustrates a front view of a portion of the refrigerator according to an embodiment of the disclosure, FIG. 3 illustrates a sectional view taken along line A-A' of the refrigerator of FIG. 2, and FIG. 4 illustrates a sectional view taken along line B-B' of the refrigerator of FIG. 2. For reference, "512" of FIG. 4 refers to a third cooling air inlet.

As illustrated in FIGS. 1 to 4, a refrigerator 1 may include a body 10, a plurality of storage compartments 20, 30, and 40 provided in the inside of the body 10, and a plurality of doors 70, 80, and 90 configured to open or close the plurality of storage compartments 20, 30, and 40.

The body 10 may include a plurality of inner cases 11 and 12 and an outer case 14 arranged on the outside of the plurality of inner cases 11 and 12 to form the appearance of the refrigerator 1. Between the plurality of inner cases 11, 12 and the outer case 14, a heat insulating material 15 is foamed and filled to prevent cooling air of the plurality of storage compartments 20, 30, and 40 from leaking out of the refrigerator 1.

The plurality of inner cases 11 and 12 may include a first inner case 11 and a second inner case 12 which are adjacent to each other in the horizontal direction Y of the refrigerator 1. The first inner case 11 may be arranged on the left of a partition wall 13 in the horizontal direction Y of the refrigerator 1, and the second inner case 12 may be arranged on the right of the partition wall 13 in the horizontal direction Y of the refrigerator 1. Between the first inner case 11 and the second inner case 12, a heat insulating material (not shown) may be foamed and filled to prevent heat exchange between a freezing compartment 20 and a plurality of refrigerating compartments 30 and 40. That is, the partition wall 13 may be filled with a heat insulating material.

The plurality of storage compartments 20, 30, and 40 may include the freezing compartment 20 provided in the inside of the body 10. Particularly, the plurality of storage compartments 20, 30, and 40 may include the freezing compartment 20 provided in the inside of the first inner case 11.

The plurality of storage compartments 20, 30, and 40 may further include the plurality of refrigerating compartments 30, and 40 provided in the inside of the body 10 to be adjacent to the freezing compartment 20 in the horizontal direction Y of the refrigerator 1. Particularly, the plurality of storage compartments 20, 30, and 40 may further include the plurality of refrigerating compartments 30, and 40 provided in the inside of the second inner case 12. The plurality of refrigerating compartments 30 and 40 may include a first refrigerating compartment 30 and a second refrigerating compartment 40. The first refrigerating compartment 30 and the second refrigerating compartment 40 may be arranged adjacent to each other in the vertical direction Z of the refrigerator 1. The first refrigerating compartment 30 and the second refrigerating compartment 40 may be divided in the vertical direction Z of the refrigerator 1 by a divider 50 to communicate with each other. Particularly, the first refrigerating compartment 30 is arranged above the divider 50 in the vertical direction Z of the refrigerator 1, and the second refrigerating compartment 40 is arranged below the divider 50 in the vertical direction Z of the refrigerator 1.

The plurality of storage compartments 20, 30, and 40 may include an open front surface.

A plurality of shelves 62 and a plurality of storage boxes 65 may be provided in the inside of the plurality of storage compartments 20, 30, and 40 so as to store food.

The plurality of doors 70, 80, and 90 may be rotatably installed in the body 10 to open or close the open front surfaces of the plurality of storage compartments 20, 30, and 40. The plurality of doors 70, 80, and 90 may include a freezing compartment door 70 rotatably installed in the body 10 to open or close the freezing compartment 20, a first refrigerating compartment door 80 rotatably installed in the body 10 to open or close the first refrigerating compartment 30, and a second refrigerating compartment door 90 rotatably installed in the body 10 to open or close the second refrigerating compartment 40.

A plurality of door guards 95 may be provided on the rear surfaces of the plurality of doors 70, 80, and 90 to accommodate food.

The plurality of doors 70, 80, and 90 may be provided with a dispenser 97 to allow a user to take out water or ice from the outside. Particularly, the dispenser 97 may be provided in the freezing compartment door 70.

An insulating material (not shown) may be foamed and filled in the inside of the plurality of doors 70, 80, and 90 to prevent cooling air of the plurality of storage compartments 20, 30, and 40 from leaking out of the refrigerator 1.

The refrigerator 1 may further include a cooling air supply device configured to supply cooling air to the plurality of inner cases 11 and 12. The cooling air supply device may include a compressor 110, a condenser 120, an expansion valve (not shown), and an evaporator 130. The compressor 110 configured to compress the refrigerant and the condenser 120 configured to condense the compressed refrigerant may be installed in a machine room 100 provided in the lower rear side of the plurality of storage compartments 20, 30, and 40. As an example, the compressor 110 may be installed in the machine room 100 to be located in the lower rear side of the plurality of refrigerating compartments 30 and 40, and the condenser 120 may be installed in the machine room 100 to be located in the lower rear side of the freezing compartment 20. The evaporator 130 may be arranged in a freezing compartment cooling space 210 to be described later.

The refrigerator 1 may further include the freezing compartment cooling space 210 arranged behind the freezing compartment 20 to communicate with the freezing compartment 20. The freezing compartment cooling space 210 may be provided in the inside of the first inner case 11 to be located behind the freezing compartment 20. The freezing compartment cooling space 210 may be formed between the first inner case 11 and a freezing compartment partition 220. Particularly, the freezing compartment cooling space 210 may be formed between a part of an inner wall of the first inner case 11 including a rear wall of the first inner case 11, and the freezing compartment partition 220.

The refrigerator 1 may further include a plurality of refrigerating compartment cooling spaces 310 and 320 arranged behind the plurality of refrigerating compartments 30 and 40 to communicate with the plurality of refrigerating compartments 30 and 40. The plurality of refrigerating compartment cooling spaces 310 and 320 may be provided in the inside of the second inner case 12 to be located behind the plurality of refrigerating compartments 30 and 40. The plurality of refrigerating compartment cooling spaces 310 and 320 may include a first refrigerating compartment cooling space 310 positioned behind the first refrigerating compartment 30 and a second refrigerating compartment cooling space 320 positioned behind the second refrigerating compartment 40. The first refrigerating compartment cooling space 310 may be provided to communicate with the first refrigerating compartment 30, and the second refrigerating compartment cooling space 320 may be provided to communicate with the second refrigerating compartment 40. The plurality of refrigerating compartment cooling spaces 310 and 320 may be formed between the second inner case 12 and a refrigerating compartment partition 330. Particularly, the plurality of refrigerating compartment cooling spaces 310 and 320 may be formed between a part of an inner wall of the second inner case 12 including a rear wall of the second inner case 12, and the refrigerating compartment partition 330.

The refrigerator 1 may further include the freezing compartment partition 220 configured to divide the first inner case 11 into the freezing compartment 20 and the freezing compartment cooling space 210. The freezing compartment 20 may be arranged in front of the freezing compartment partition 220 in the front and rear direction X of the refrigerator 1, and the freezing compartment cooling space 210 may be arranged behind the freezing compartment partition 220 in the front and rear direction X of the refrigerator 1. The freezing compartment partition 220 may include a freezing compartment duct 230 and a separator plate 240. The freezing compartment duct 230 may be positioned above the separator plate 240 in the vertical direction Z of the refrigerator 1. The freezing compartment partition 220 may include at least one outlet 222 configured to allow the cooling air generated by the evaporator 130 to be supplied to the freezing compartment 20. Particularly, at least one outlet 222 may be formed in a front frame 231 and the separator plate 240 of the freezing compartment duct 230.

The refrigerator 1 may further include the freezing compartment duct 230 configured to supply cooling air to the freezing compartment 20. The freezing compartment duct 230 may include the front frame 231 forming the rear surface of the freezing compartment 20 and in which the at least one outlet 222 is formed, and a rear frame 232 coupled to the front frame 231. In addition, the freezing compartment duct 230 may further include an inner space 233 formed between the front frame 231 and the rear frame 232.

The separator plate 240 may be coupled to the freezing compartment duct 230 to form the rear surface of the freezing compartment 20 together with the front frame 231 of the freezing compartment duct 230.

The refrigerator 1 may further include a blowing fan 250 configured to circulate the cooling air generated by the evaporator 130. The blowing fan 250 may be arranged in the inner space 233 of the freezing compartment duct 230. Particularly, the blowing fan 250 may be installed in the front frame 231 of the freezing compartment duct 230 so that the cooling air generated by the evaporator 130 flows into the inner space 233 of the freezing compartment duct 230 through the freezing compartment cooling space 210.

The blowing fan 250 may be positioned above the evaporator 130 in the vertical direction Z of the refrigerator 1. When the blowing fan 250 is operated, the cooling air generated by the evaporator 130 may flow upward and flow into the inner space 233 of the freezing compartment duct 230 through the blowing fan 250, and the cooling air flowing into the inner space 233 of the freezing compartment duct 230 may be supplied to the freezing compartment 20 through the at least one outlet 222 formed in the freezing compartment partition 220.

The refrigerator 1 may further include the refrigerating compartment partition 330 configured to divide the second inner case 12 into the plurality of refrigerating compartments 30 and 40 and the plurality of refrigerating compartment cooling spaces 310 and 320. The plurality of refrigerating compartments 30 and 40 may be arranged in front of the refrigerating compartment partition 330 in the front and rear direction X of the refrigerator 1, and the plurality of refrigerating compartment cooling spaces 310 and 320 may be arranged behind the refrigerating compartment partition 330 in the front and rear direction X of the refrigerator 1. The refrigerating compartment partition 330 may form the rear surface of the plurality of refrigerating compartments 30 and 40. The refrigerating compartment partition 330 may include at least one outlet 333 so that the cooling air generated in the evaporator 130 is supplied to the plurality of refrigerating compartments 30 and 40 by sequentially passing through the freezing compartment duct 230 and the plurality of refrigerating compartment cooling spaces 310 and 320.

The refrigerator 1 may further include a plurality of temperature sensors (not shown). The plurality of temperature sensors may include a first temperature sensor provided in the first refrigerating compartment 30 to detect the temperature of the first refrigerating compartment 30, and a second temperature sensor provided in the second refrigerating compartment 40 to detect the temperature of the second refrigerating compartment 40. A plurality of dampers 600 and 700 (refer to FIG. 9) to be described later may open or close a cooling air supply duct 400 (refer to FIG. 5) based on a detection result of the plurality of temperature sensors. As an example, when the temperature detected by the plurality of temperature sensors is higher than a predetermined temperature, the plurality of dampers 600 and 700 may open the cooling air supply duct 400. On the contrary, when the temperature sensed by the plurality of temperature sensors is equal to or lower than the predetermined temperature, the plurality of dampers 600 and 700 may close the cooling air supply duct 400.

Figure 5:
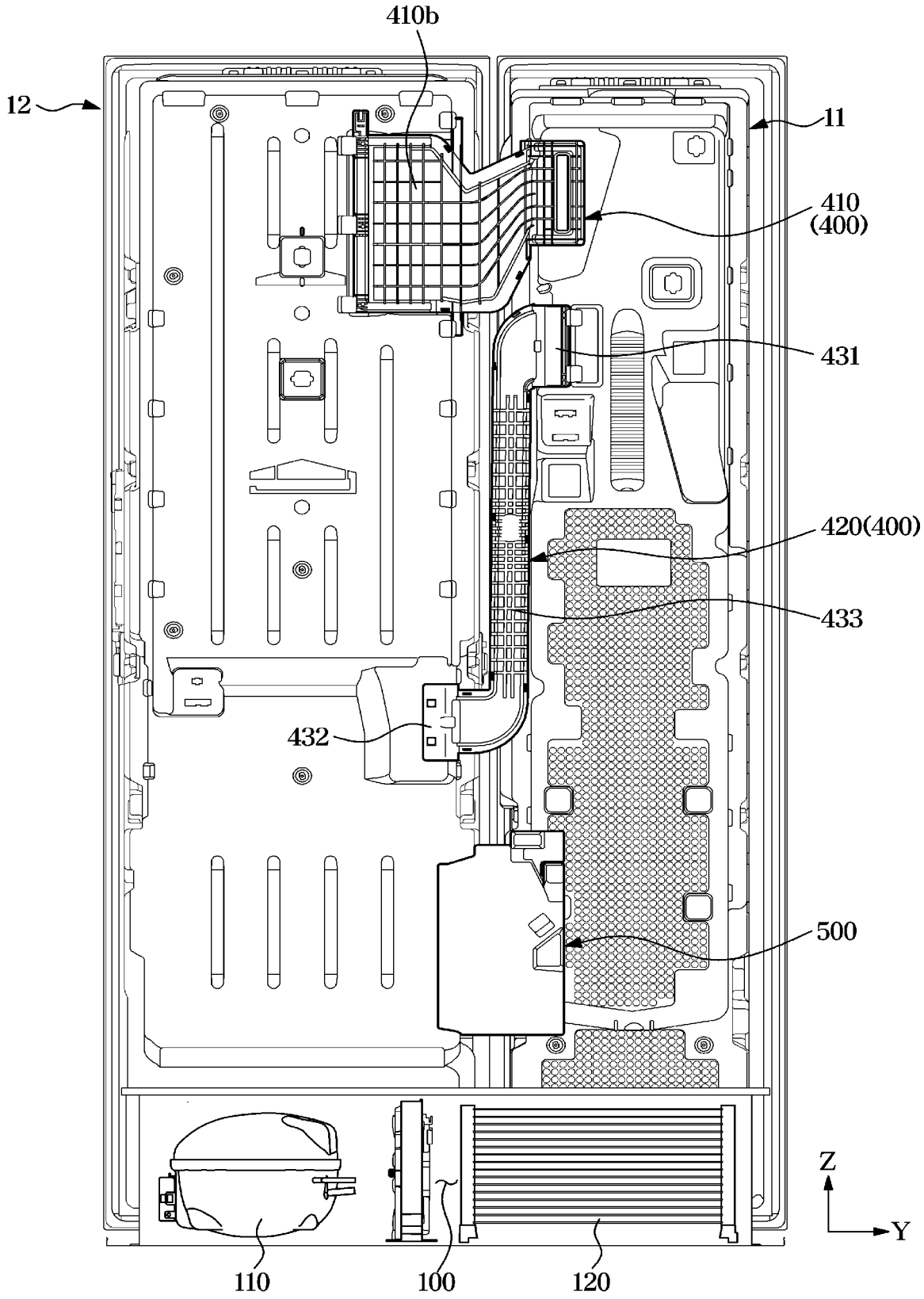
FIG. 5 illustrates a rear view of a portion of the refrigerator according to an embodiment of the disclosure.
Figure 6A:
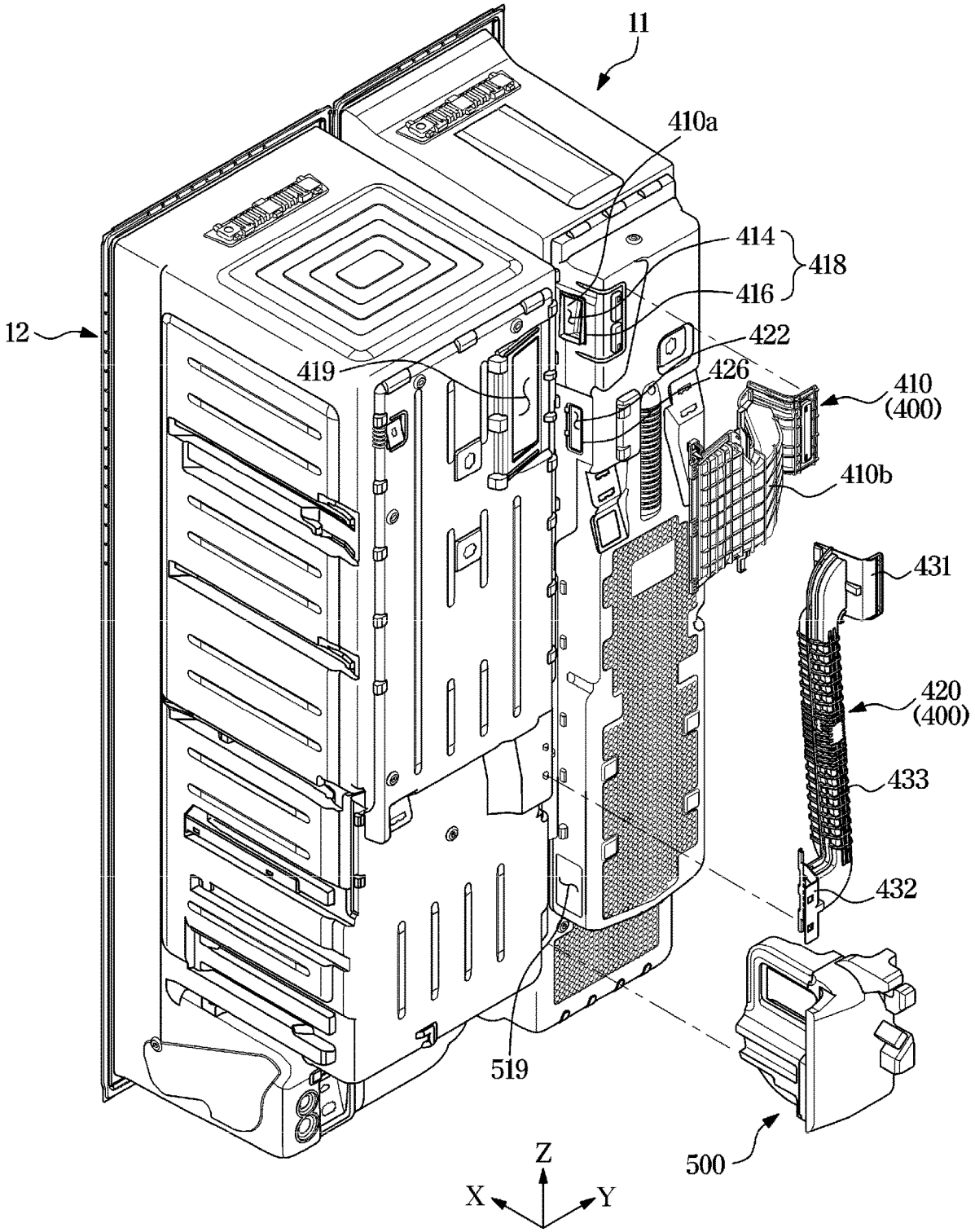
FIG. 6A illustrates a rear perspective view of a portion of the refrigerator according to an embodiment of the disclosure.
Figure 6B:
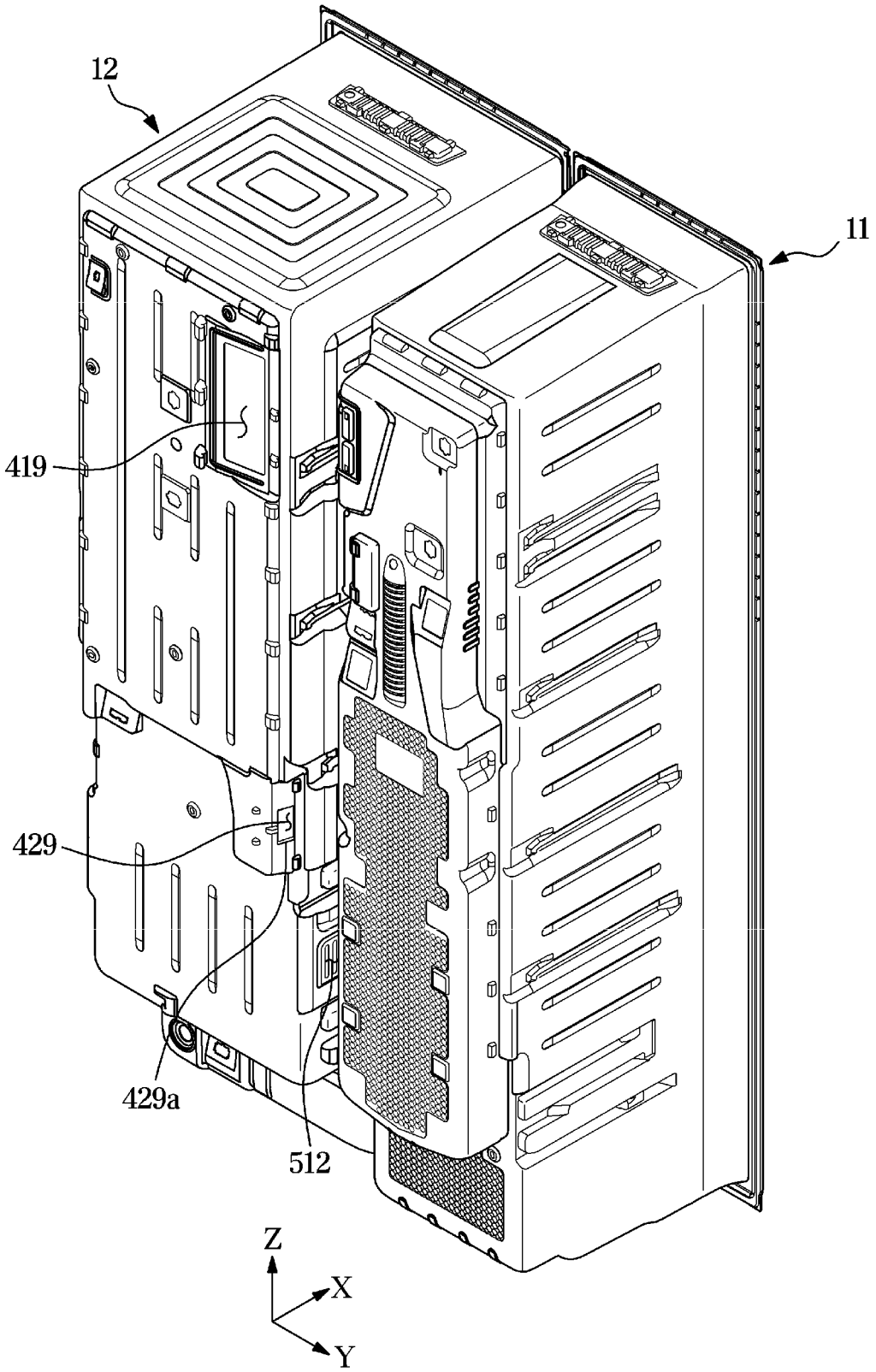
FIG. 6B illustrates a rear perspective view of a portion of the refrigerator when viewed from a direction different from FIG. 6A.

FIG. 5 illustrates a rear view of a portion of the refrigerator according to an embodiment of the disclosure, FIG. 6A illustrates a rear perspective view of a portion of the refrigerator according to an embodiment of the disclosure. FIG. 6B illustrates a rear perspective view of a portion of the refrigerator when viewed from a direction different from FIG. 6A. For reference, in FIG. 6B, the cooling air supply duct 400 and a cooling air circulation duct 500 shown in FIG. 6A are omitted. In addition, a third duct 500 refers to the same configuration as the cooling air circulation duct 500.

As illustrated in FIGS. 5 to 6B, the refrigerator 1 may further include the cooling air supply duct 400 configured to allow the cooling air generated by the evaporator 130 to be supplied to the plurality of refrigerating compartments 30 and 40.

The cooling air supply duct 400 may include a first duct 410 configured to allow the cooling air generated by the evaporator 130 to be supplied to the first refrigerating compartment 30. The first duct 410 may connect the freezing compartment duct 230 to the first refrigerating compartment cooling space 310. The first duct 410 may include a first unit 410*a* arranged in the inner space 233 of the freezing compartment duct 230, and a second unit 410*b* configured to connect the first unit 410*a* to the first refrigerating compartment cooling space 310. The first unit 410*a* and the second unit 410*b* may communicate with each other. The second unit 410*b* may be arranged outside the rear side of the first inner case 11 and the second inner case 12 to connect the first unit 410*a* to the first refrigerating compartment cooling space 310. The first duct 410 may further include a first cooling air inlet 412 (refer to FIG. 7A). Particularly, the first cooling air inlet 412 may be formed at one end of the first unit 410*a* facing the blowing fan 250. An opening 414 may be formed at the other end of the first unit 410*a* positioned opposite to one end of the first unit 410*a* in which the first cooling air inlet 412 is formed. The opening 414 formed at the other end of the first unit 410*a* may form a communication port 418 together with an opening formed on one wall of the rear frame 232 of the freezing compartment duct 230 and an opening 416 formed on one wall of the first inner case 11. Cooling air flowing through the first cooling air inlet 412 may be discharged to the first refrigerating compartment cooling space 310 through a first cooling air outlet 419. The first cooling air outlet 419 may be formed on one wall of the first refrigerating compartment cooling space 310. In other words, the first cooling air outlet 419 may be formed on one wall of the second inner case 12 forming the first refrigerating compartment cooling space 310. One end of the second unit 410*b* of the first duct 410 may be coupled to the first inner case 11 to cover the communication port 418, and the other end of the second unit 410*b* of the first duct 410 may be coupled to second inner case 12 to cover the first cooling air outlet 419.

An upper end portion 412*a* (refer to FIG. 7A) of the first cooling air inlet 412 may be closer to the blowing fan 250 than a lower end portion 421*b* (refer to FIG. 7A) of the first cooling air inlet 412 in the horizontal direction Y of the refrigerator 1. In another aspect, a straight line L connecting the upper end portion 412*a* to the lower end portion 412*b* of the first cooling air inlet 412 may be inclined toward the blowing fan 250 with respect to a reference line R passing through the lower end portion 412*b* of the first cooling air inlet 412 and extending in the vertical line Z of the refrigerator 1.

The first cooling air inlet 412 and the first cooling air outlet 419 may be formed at approximately the same position in the vertical direction Z of the refrigerator 1. The size of the first cooling air inlet 412 may be smaller than the size of the first cooling air outlet 419. However, the position and size of the first cooling air inlet 412 and the first cooling air outlet 419 are not limited thereto and thus the position and size of the first cooling air inlet 412 and the first cooling air outlet 419 may be variously changed.

The first cooling air inlet 412 may be positioned above a second cooling air inlet 422 to be described later in the vertical direction Z of the refrigerator 1.

The cooling air supply duct 400 may further include a second duct 420 configured to allow cooling air generated by the evaporator 130 to be supplied to the second refrigerating compartment 40. The second duct 420 may connect the freezing compartment duct 230 to the second refrigerating compartment cooling space 320. One end of the second duct 420 may be coupled to the first inner case 11 to cover the second cooling air inlet 422 formed on one wall of the freezing compartment duct 230. Particularly, the second cooling air inlet 422 may be formed on one wall of the rear frame 232 of the freezing compartment duct 230. An opening 426 corresponding to the second cooling air inlet 422 may be formed on one wall of the first inner case 11. The cooling air flowing through the second cooling air inlet 422 may be discharged into the second refrigerating compartment cooling space 320 through the second cooling air outlet 429. The second cooling air outlet 429 may be formed in the refrigerating compartment partition 330 positioned in the second refrigerating compartment cooling space 320. An opening 429*a* corresponding to the second cooling air outlet 429 may be formed on one wall of the second inner case 12. The other end of the second duct 420 may be coupled to the second inner case 12 to cover the second cooling air outlet 429.

The second duct 420 may include a first coupler 431 coupled to the first inner case 11 to cover the second cooling air inlet 422, a second coupler 432 coupled to the second inner case 12 to cover the second cooling air outlet 429, and a connector 433 configured to connect the first coupler 431 to the second coupler 432. The connector 433 of the second duct 420 may elongate in the vertical direction Z of the refrigerator 1. The connector 433 of the second duct 420 may have a substantially straight shape. The first coupler 431 of the second duct 420 may be bent to extend from an upper end of the connector 433 toward the first inner case 11. The second coupler 432 of the second duct 420 may be bent to extend from a lower end of the connector 433 toward the second inner case 12.

The second cooling air inlet 422 and the second cooling air outlet 429 may be formed to be positioned at different positions in the vertical direction Z of the refrigerator 1. As an example, the second cooling air inlet 422 may be positioned above the second cooling air outlet 429 in the vertical direction Z of the refrigerator 1. However, the positions of the second cooling air inlet 422 and the second cooling air outlet 429 are not limited thereto and thus the positions of the second cooling air inlet 422 and the second cooling air outlet 429 may be variously changed.

The refrigerator 1 may further include the cooling air circulation duct 500 configured to allow air, which is introduced through the first cooling air inlet 412 and circulated through the first refrigerating compartment 30, and air, which is introduced through the second cooling air inlet 422 and circulated through the second refrigerating compartment 40, to be supplied to the freezing compartment cooling space 210. The cooling air circulation duct 500 may connect the second refrigerating compartment 40 to the freezing compartment cooling space 210. A third cooling air inlet 512 to which one end of the cooling air circulation duct 500 is connected may be formed on one wall of the second refrigerating compartment 40. Particularly, the third cooling air inlet 512 may be formed on one wall of the second inner case 12 forming the second refrigerating compartment 40. More particularly, the second inner case 12 may include a side wall facing the first inner case 11, and the third cooling air inlet 512 may be formed on a side wall of the second inner case 12 defining the second refrigerating compartment 40. A third cooling air outlet 519 to which the other end of the cooling air circulation duct 500 is connected may be formed on one wall of the freezing compartment cooling spaces 210 so that the cooling air introduced through the third cooling air inlet 512 is discharged to the lower portion of the evaporator 130. In other words, the third cooling air outlet 519 may be formed on one wall of the first inner case 11 forming the freezing compartment cooling space 210.

The third cooling air inlet 512 and the third cooling air outlet 519 may be formed to be positioned at different positions in the vertical direction Z of the refrigerator 1. For example, the third cooling air inlet 512 may be positioned above the third cooling air outlet 519 in the vertical direction Z of the refrigerator 1. However, the positions of the third cooling air inlet 512 and the third cooling air outlet 519 are not limited thereto and thus the positions of the third cooling air inlet 512 and the third cooling air outlet 519 may be variously changed.

The cooling air circulation duct 500 may include a flow path 520 (refer to FIG. 7A) provided in the cooling air circulation duct 500 to allow the air circulated through the plurality of refrigerating compartments 30 and 40 to flow. The flow path 520 may include a first section 521 connected to the third cooling air inlet 512, a second section 522 connected to the third cooling air outlet 519, and a third section 523 provided to connect the first section 521 to the second section 522 and formed to be inclined. The first section 521 may be bent to extend from an upper end of the third section 523 toward the second refrigerating compartment 40. The second section 522 may be bent to extend from the lower end of the third section 523 toward the freezing compartment 20.

Figure 7A:
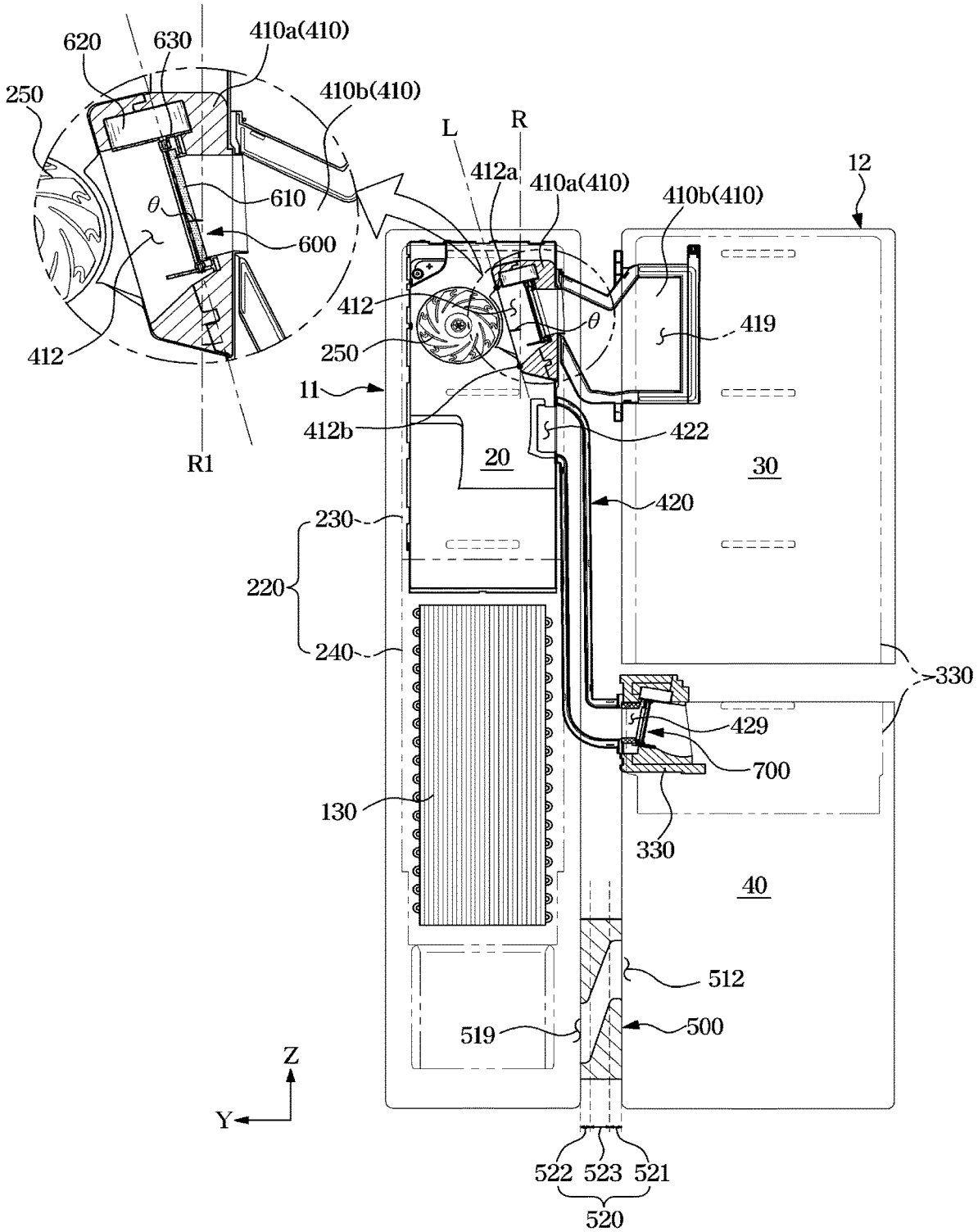
FIG. 7A is a view illustrating a state in which a first duct is closed by a first damper in the refrigerator according to an embodiment of the disclosure.
Figure 7B:
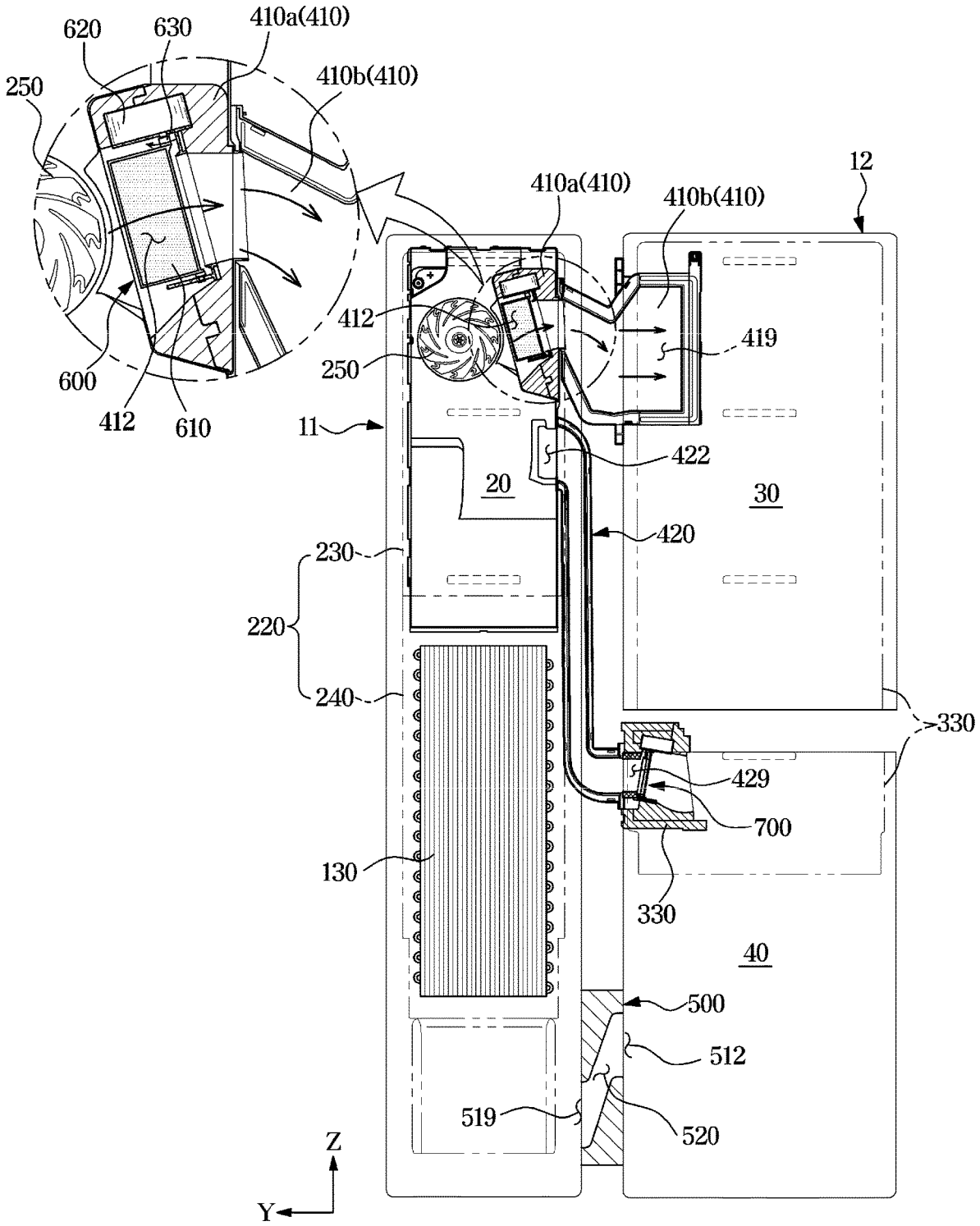
FIG. 7B is a view illustrating a state in which the first duct is opened by the first damper in the refrigerator according to an embodiment of the disclosure.

FIG. 7A is a view illustrating a state in which a first duct is closed by a first damper in the refrigerator according to an embodiment of the disclosure, and FIG. 7B is a view illustrating a state in which the first duct is opened by the first damper in the refrigerator according to an embodiment of the disclosure. For reference, in FIGS. 7A and 7B, the second duct 420 is closed by a second damper 700.

As illustrated in FIGS. 7A and 7B, the refrigerator 1 may further include a plurality of dampers 600 and 700 provided in the cooling air supply duct 400 to independently control whether to provide cooling air to each of the plurality of refrigerating compartments 30 and 40. In other words, the refrigerator 1 may further include the plurality of dampers 600 and 700 provided in the cooling air supply duct 400 to independently control whether to provide cooling air to each of the plurality of refrigerating compartment cooling spaces 310 and 320.

The freezing compartment 20 may be maintained at temperatures below zero. The plurality of refrigerating compartments 30 and 40 may be maintained at temperature above zero. It is appropriate that the temperatures of the plurality of refrigerating compartments 30 and 40 may be different depending on the type of food stored in the plurality of refrigerating compartments 30 and 40. Alternatively, the temperatures of the plurality of refrigerating compartments 30 and 40 may be the same. Cooling air of about −20° C. generated by the evaporator 130 may be directly supplied to the freezing compartment 20 through the freezing compartment duct 230 or supplied to the plurality of refrigerating compartments 30 and 40 through the freezing compartment duct 230 and the cooling air supply duct 400 connected to the freezing compartment duct 230. The plurality of dampers 600 and 700 may be provided in the cooling air supply duct 400 to prevent cooling air from being additionally supplied to the plurality of refrigerating compartments 30 and 40 when the temperatures of the plurality of refrigerating compartments 30 and 40 are maintained at the predetermined temperature.

The plurality of dampers 600 and 700 may include a first damper 600 configured to selectively open or close the first duct 410. As an example, the first damper 600 may be configured to selectively open or close the first cooling air inlet 412. However, the first damper 600 may be configured to open or close the first duct 410 and may not necessarily be configured to open or close the first cooling air inlet 412.

The first damper 600 may be rotatably installed in the first unit 410*a* of the first duct 410 arranged in the inner space 233 of the freezing compartment duct 230. The first damper 600 may include a door 610 configured to selectively open or close the first duct 410 and a driver 620 configured to drive the door 610. The door 610 of the first damper 600 may be rotatable about a door rotation shaft 630. It is appropriate that the door 610 of the first damper 600 may be configured to selectively open or close the first cooling air inlet 412 of the first duct 410.

The door rotation shaft 630 of the first damper 600 may be inclined toward the blowing fan 250 with respect to the reference line R1 passing through a lower end portion of the door rotation shaft 630 and extending in the vertical direction Z of the refrigerator 1. In another aspect, the door rotation shaft 630 of the first damper 600 and the first cooling air inlet 412 of the first duct 410 may be inclined toward the blowing fan 250. As an example, the degree of inclination of the door rotation shaft 630 of the first damper 600 and the degree of inclination of the first cooling air inlet 412 of the first duct 410 may be the same. However, the degree of inclination of the door rotation shaft 630 of the first damper 600 and the degree of inclination of the first cooling air inlet 412 of the first duct 410 are not limited thereto and thus the degree of the inclination thereof may be variously changed.

The plurality of dampers 600 and 700 may further include a second damper 700 configured to selectively open or close the second duct 420. The second damper 700 may selectively open or close the second duct 420 independently of the first damper 600. As an example, the second damper 700 may be configured to selectively open or close the second cooling air outlet 429. However, the second damper 700 may be configured to open or close the second duct 420 and may not necessarily be configured to open or close the second cooling air outlet 429.

The second damper 700 may be rotatably installed in the refrigerating compartment partition 330. The second damper 700 may include a door 710 configured to selectively open or close the second duct 420, and a driver 720 configured to drive the door 710. The door 710 of the second damper 700 may be rotatable about a door rotation shaft 730. It is appropriate that the door 710 of the second damper 700 may selectively open or close the second cooling air outlet 429.

The door rotation shaft 730 of the second damper 700 may be inclined toward the inner direction of the second inner case 12 with respect to a reference line R2 passing through a lower end portion of the door rotation shaft 730 and extending in the vertical direction Z of the refrigerator 1.

The plurality of dampers 600 and 700 may include an electric damper.

The first cooling air inlet 412 and the second cooling air inlet 422 may be located above the evaporator 130.

When the first cooling air inlet 412 and the second cooling air inlet 422 are formed adjacent to the evaporator 130, various difficulties may occur. As an example, when the first cooling air inlet 412 and the second cooling air inlet 422 are formed to face the evaporator 130, the first cooling air inlet 412 and the second cooling air inlet 422 may be frozen due to the low temperature of the evaporator 130. When the first cooling air inlet 412 and the second cooling air inlet 422 are frozen, the cooling air generated by the evaporator 130 may not move to the plurality of refrigerating compartments 30 and 40, and thus cooling efficiency of the plurality of refrigerating compartments 30 and 40 may decrease. In addition, when the first cooling air inlet 412 and the second cooling air inlet 422 are formed to face the evaporator 130, the defrost heat used in the defrosting operation of the refrigerator 1 may be leaked through the first cooling air inlet 412 and the second cooling air inlet 422. When the defrost heat is leaked through the first cooling air inlet 412 and the second cooling air inlet 422, it is difficult to expect a sufficient defrosting effect on the evaporator 130 due to the lack of defrost heat. In addition, the defrost heat leaked through the first cooling air inlet 412 and the second cooling air inlet 422 may be introduced into the plurality of refrigerating compartments 30 and 40, thereby increasing the temperatures of the plurality of refrigerating compartments 30 and 40.

To alleviate the above mentioned difficulties, the first cooling air inlet 412 and the second cooling air inlet 422 may be formed above the evaporator 130. By designing the refrigerator 1 such that the first cooling air inlet 412 and the second cooling air inlet 422 are positioned above the evaporator 130, it is possible to effectively prevent various difficulties due to clogging of the cooling air supply duct 400 caused by freezing, or due to leakage of defrost heat.

As illustrated in FIG. 7A, when the first duct 410 is closed by the first damper 600, the cooling air generated by the evaporator 130 may not flow into the first refrigerating compartment 30. Because the second duct 420 is closed by the second damper 700, the cooling air generated by the evaporator 130 may be used to cool the freezing compartment 20.

As illustrated in FIG. 7B, when the first duct 410 is opened by the first damper 600, the cooling air generated by the evaporator 130 may flow into the first refrigerating compartment 30. The cooling air generated by the evaporator 130 may be introduced into the first refrigerating compartment 30 through the first duct 410. Because the second duct 420 is closed by the second damper 700, the cooling air generated by the evaporator 130 may be used to cool the freezing compartment 20 and the first refrigerating compartment 30.

Figure 8A:
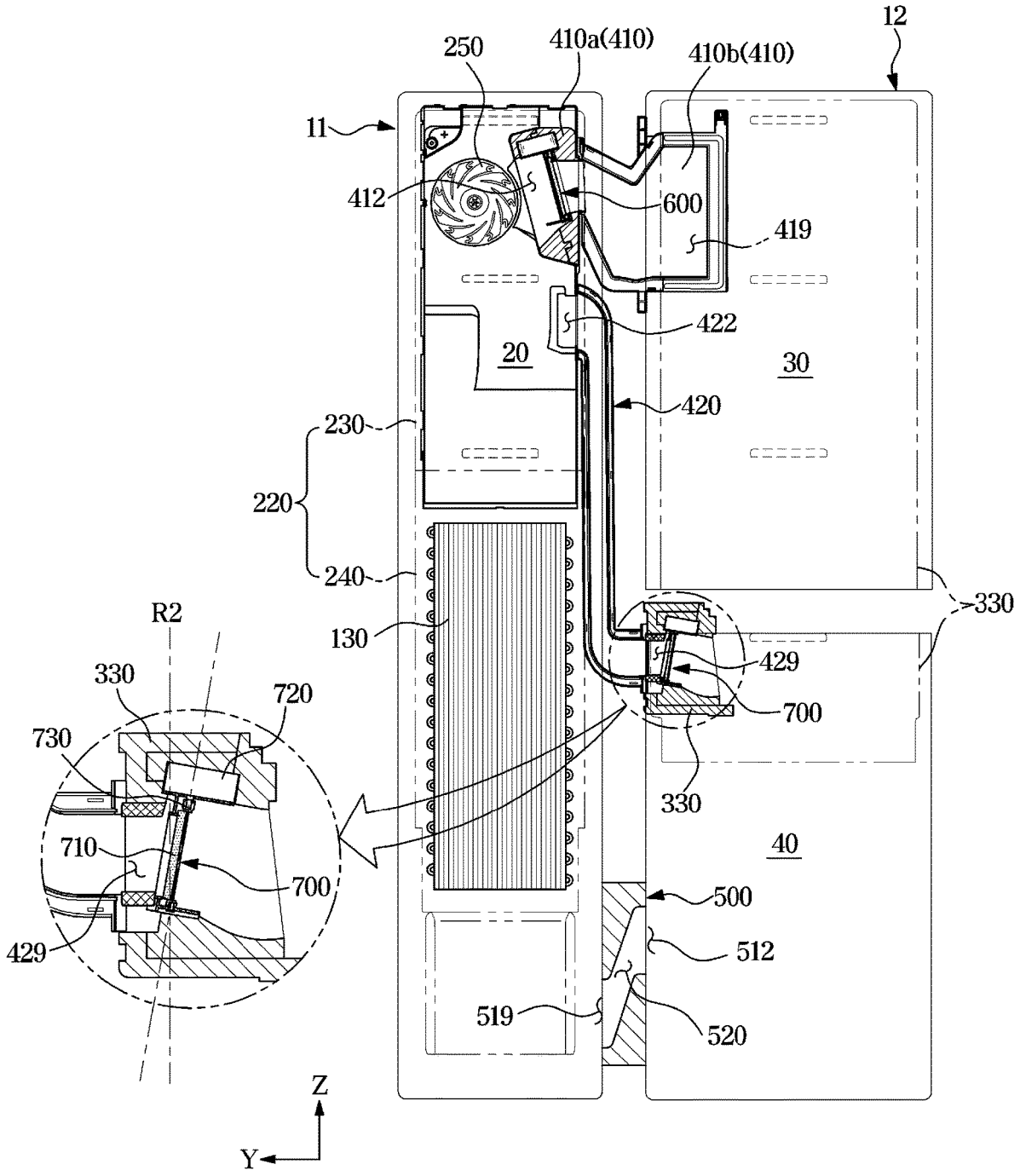
FIG. 8A is a view illustrating a state in which a second duct is closed by a second damper in the refrigerator according to an embodiment of the disclosure.
Figure 8B:
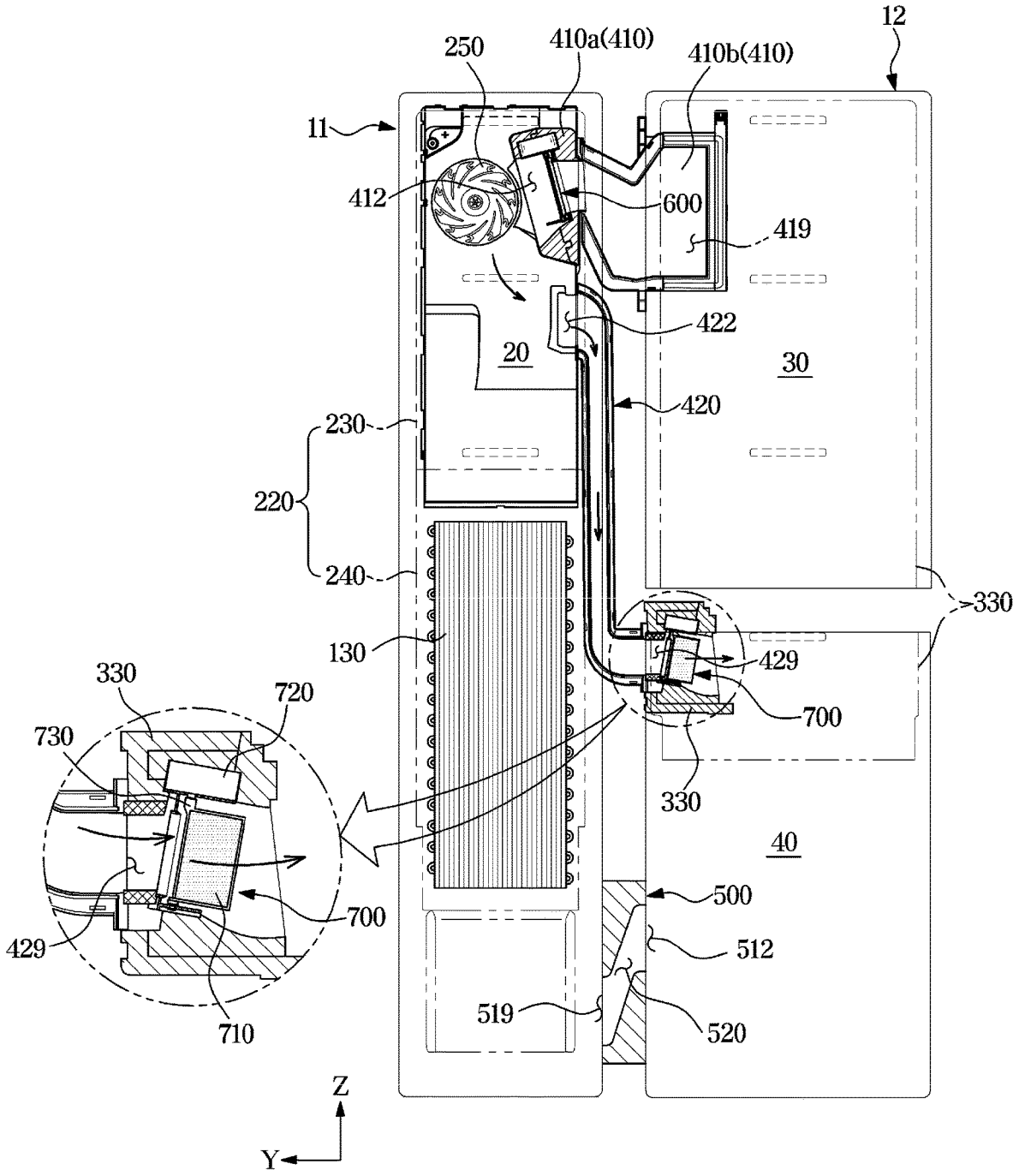
FIG. 8B is a view illustrating a state in which the second duct is opened by the second damper in the refrigerator according to an embodiment of the disclosure.

FIG. 8A is a view illustrating a state in which a second duct is closed by a second damper in the refrigerator according to an embodiment of the disclosure and FIG. 8B is a view illustrating a state in which the second duct is opened by the second damper in the refrigerator according to an embodiment of the disclosure. For reference, in FIGS. 8A and 8B, the first duct 410 is closed by the first damper 600.

As illustrated in FIG. 8A, when the second duct 420 is closed by the second damper 700, the cooling air generated by the evaporator 130 may not flow into the second refrigerating compartment 40. Because the first duct 410 is closed by the first damper 600, the cooling air generated by the evaporator 130 may be used to cool the freezing compartment 20.

As illustrated in FIG. 8B, when the second duct 420 is opened by the second damper 700, the cool air generated by the evaporator 130 may flow into the second refrigerating compartment 40. The cooling air generated by the evaporator 130 may be introduced into the second refrigerating compartment 40 through the second duct 420. Because the first duct 410 is closed by the first damper 600, the cooling air generated by the evaporator 130 may be used to cool the freezing compartment 20 and the second refrigerating compartment 40.

Figure 9:
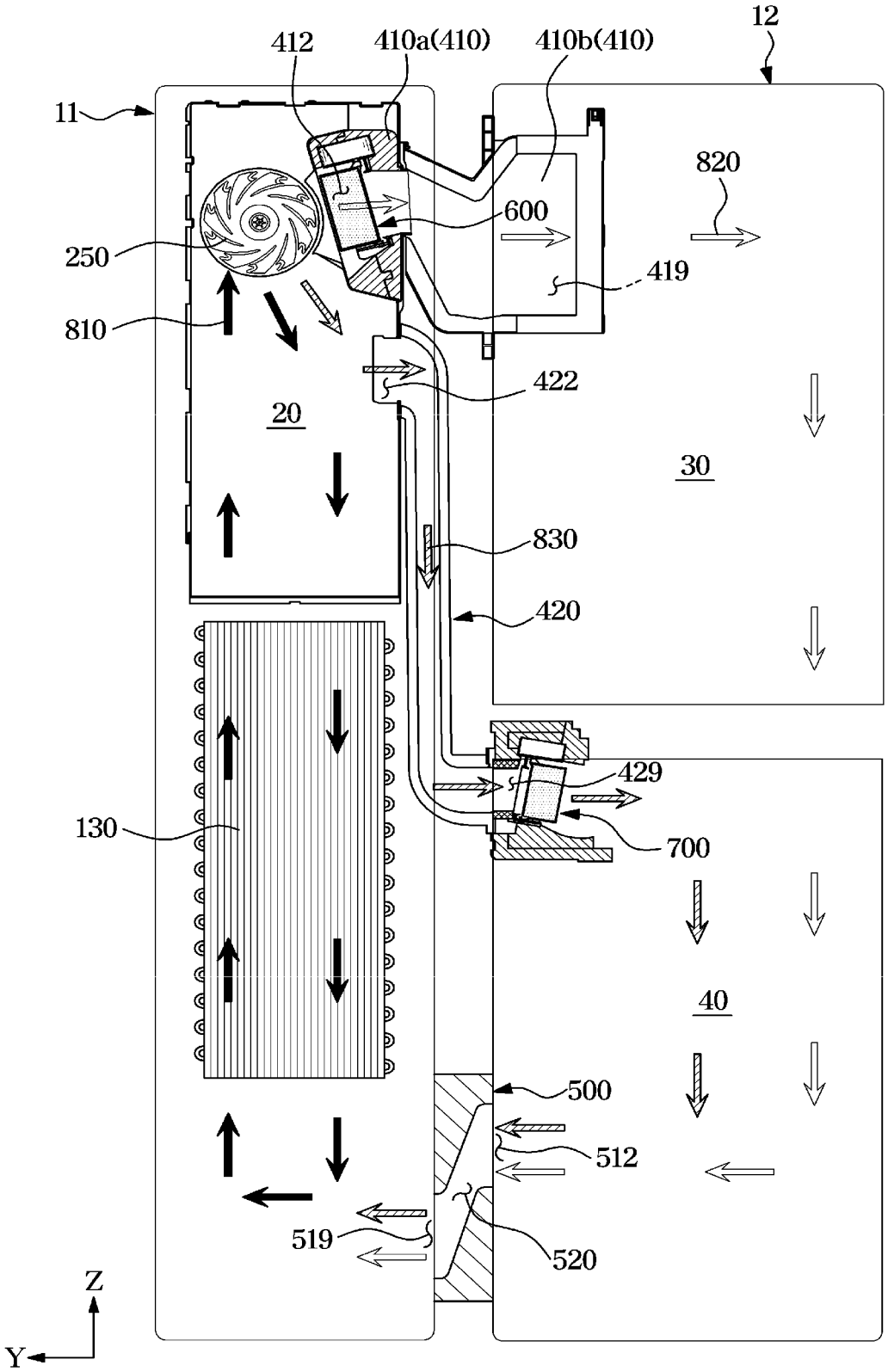
FIG. 9 is a view illustrating a flow of cooling air in the refrigerator according to an embodiment of the disclosure.

FIG. 9 is a view illustrating a flow of cooling air in the refrigerator according to an embodiment of the disclosure. For reference, in FIG. 9, the first duct 410 and the second duct 420 are open.

As illustrated in FIG. 9, the cooling air generated by one evaporator 130 may be used to cool the freezing compartment 20 and the plurality of storage compartments 20, 30, and 40.

The refrigerator 1 may include a first flow path 810 configured to cool the freezing compartment 20. The cooling air generated by the evaporator 130 may be introduced into the freezing compartment 20 along the first flow path 810. The cooling air generated by the evaporator 130 may be introduced into the freezing compartment duct 230 by the blowing fan 250 and then introduced into the freezing compartment 20 through the at least one outlet 222 formed in the freezing compartment partition 220. The cooling air introduced into the freezing compartment 20 may cool the freezing compartment 20 while circulating in the freezing compartment 20. The cooling air used to cool the freezing compartment 20 may flow back into the freezing compartment cooling space 210 to exchange heat in the evaporator 130.

The refrigerator 1 may further include a second flow path 820 configured to cool the first refrigerating compartment 30. The cooling air generated by the evaporator 130 may be introduced into the first refrigerating compartment 30 along the second flow path 820. The cooling air generated by the evaporator 130 may be introduced into the freezing compartment duct 230 by the blowing fan 250 and then introduced into the first refrigerating compartment cooling space 310 through the first duct 410. The cooling air introduced into the first refrigerating compartment cooling space 310 may be introduced into the first refrigerating compartment 30 through the at least one outlet 333 formed on the refrigerating compartment partition 330. The cooling air introduced into the first refrigerating compartment 30 may cool the first refrigerating compartment 30 while circulating the first refrigerating compartment 30. After the circulation of the first refrigerating compartment 30 is completed, the cooling air may be discharged to the freezing compartment cooling space 210 through the third duct 500.

The refrigerator 1 may further include a third flow path 830 configured to cool the second refrigerating compartment 40 independently of the first refrigerating compartment 30. The cooling air generated by the evaporator 130 may be introduced into the second refrigerating compartment 40 along the third flow path 830. The cooling air generated by the evaporator 130 may be introduced into the freezing compartment duct 230 by the blowing fan 250 and then introduced into the second refrigerating compartment cooling space 320 through the second duct 420. The cooling air introduced into the second refrigerating compartment cooling space 320 may be introduced into the second refrigerating compartment 40 through the at least one outlet 333 formed in the refrigerating compartment partition 330. The cooling air introduced into the second refrigerating compartment 40 may cool the second refrigerating compartment 40 while circulating the second refrigerating compartment 40. After the circulation of the second refrigerating compartment 40 is completed, the cooling air may be discharged to the freezing compartment cooling space 210 through the third duct 500.

Figure 10:
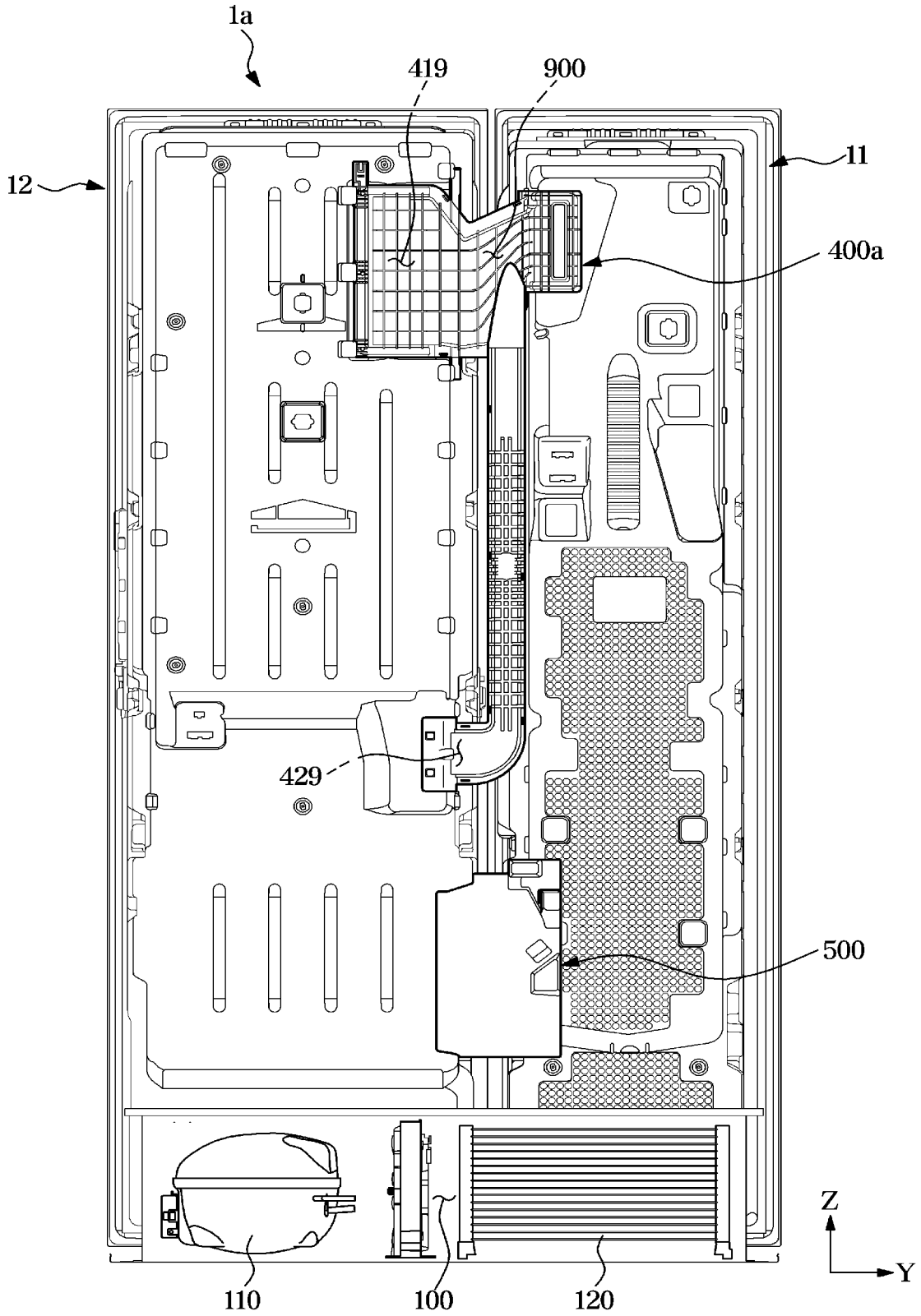
FIG. 10 illustrates a rear view of a portion of a refrigerator according to another embodiment of the disclosure.

FIG. 10 illustrates a rear view of a portion of a refrigerator according to another embodiment of the disclosure. Hereinafter a description of the same parts as those shown in FIGS. 1 to 9 will be omitted.

As illustrated in FIG. 10, a refrigerator 1*a* may include a cooling air supply duct 400*a* configured to allow cooling air generated by an evaporator 130 to be supplied to a plurality of refrigerating compartments 30 and 40. The cooling air supply duct 400*a* may include a cooling air inlet 900 positioned above the evaporator 130.

The cooling air introduced through the cooling air inlet 900 may be discharged into a first refrigerating compartment cooling space 310 through a first cooling air outlet 419. The first cooling air outlet 419 may be formed on one wall of the first refrigerating compartment cooling space 310.

The cooling air introduced through the cooling air inlet 900 may be discharged into a second refrigerating compartment cooling space 320 through the second cooling air outlet 429. The second cooling air outlet 429 may be formed on a refrigerating compartment partition 330 positioned in a second refrigerating compartment cooling space 320.

The cooling air supply duct 400*a* may connect the cooling air inlet 900, the first cooling air outlet 419, and the second cooling air outlet 429. The cooling air introduced through the cooling air inlet 900 is branched inside the cooling air supply duct 400*a*. Therefore, a portion of the cooling air may be discharged into the first refrigerating compartment cooling space 310 through the first cooling air outlet, and the other portion of the cooling air may be discharged to the second refrigerating compartment cooling space 320 through the second cooling air outlet 429.

That is, the cooling air supply duct may be composed of a plurality of ducts, such as the cooling air supply duct 400 described with reference to FIGS. 1 to 9, but may also be composed of one duct such as the cooling air supply duct 400*a* described with reference to FIG. 10.

The disclosure may be applied to various types of refrigerators. That is, the disclosure may be applied to a refrigerator having a freezing compartment and a plurality of refrigerating compartments regardless of the arrangement of the freezing compartment and the plurality of refrigerating compartments.

As is apparent from the above description, the refrigerator may independently control the temperature of the plurality of refrigerating compartments by installing the plurality of dampers in the cooling air supply ducts configured to allow the cooling air generated by the evaporator to be supplied to the plurality of refrigerating compartments.

Although a few embodiments of the disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a first inner case including a freezing compartment provided in an inside of the first inner case;

a second inner case adjacent to the first inner case in a horizontal direction and including a plurality of refrigerating compartments provided in an inside of the second inner case, the plurality of refrigerating compartments comprising a first refrigerating compartment and a second refrigerating compartment disposed below the first refrigerating compartment;

a freezing compartment partition configured to divide the inside of the first inner case into the freezing compartment and a freezing compartment cooling space arranged behind the freezing compartment inside of the first inner case, the freezing compartment partition comprising a freezing compartment duct to allow the freezing compartment cooling space to communicate with the freezing compartment;

an evaporator arranged in the freezing compartment cooling space below the freezing compartment duct and configured to generate cooling air, a refrigerating compartment partition to divide the inside of the second inner case into the plurality of refrigerating compartments and a plurality of refrigerating compartment cooling spaces arranged behind the plurality of refrigerating compartments, the plurality of refrigerating compartment cooling spaces comprising a first refrigerating compartment cooling space behind the first refrigerating compartment to communicate with the first refrigerating compartment, and a second refrigerating compartment cooling space behind the second refrigerating compartment to communicate with the second refrigerating compartment;

a first duct connecting the freezing compartment duct and the first refrigerating compartment cooling space to allow the cooling air generated by the evaporator to be supplied to the first refrigerating compartment, the first duct comprising a first cooling air inlet;

a second duct connecting the freezing compartment duct and the second refrigerating compartment cooling space to allow the cooling air generated by the evaporator to be supplied to the second refrigerating compartment through a second cooling air inlet formed on a side wall of the freezing compartment duct, the first cooling air inlet being positioned above the second cooling air inlet;

a first damper configured to open or close the first duct; and a second damper configured to open or close the second duct, wherein the first cooling air inlet and the second cooling air inlet are arranged above the evaporator.

2. The refrigerator of claim 1, wherein the first damper is installed in the freezing compartment duct and the second damper is installed in the refrigerating compartment partition.

3. The refrigerator of claim 1, wherein:

the cooling air introduced through the first cooling air inlet is discharged into the first refrigerating compartment cooling space through a first cooling air outlet, and the cooling air introduced through the second cooling air inlet is discharged into the second refrigerating compartment cooling space through a second cooling air outlet.

4. The refrigerator of claim 3, wherein the second cooling air inlet is arranged above the second cooling air outlet.

5. The refrigerator of claim 1, further comprising a third duct configured to supply air introduced through the first cooling air inlet and circulated through the first refrigerating compartment and air introduced through the second cooling air inlet and circulated through the second refrigerating compartment to the freezing compartment cooling space.

6. The refrigerator of claim 5, wherein the third duct connects the second refrigerating compartment to the freezing compartment cooling space.

7. The refrigerator of claim 6, wherein the third duct connects a third cooling air inlet formed on a side wall of the second inner case to a third cooling air outlet formed on a side wall of the first inner case to discharge cooling air introduced through the third cooling air inlet to a lower side of the evaporator.

8. The refrigerator of claim 7, wherein the third cooling air inlet is arranged above the third cooling air outlet.

* * * * *